US005593378A

United States Patent [19]

Dyck

[11] Patent Number: 5,593,378

[45] Date of Patent: Jan. 14, 1997

[54] CENTRIFUGAL SEPARATOR FOR FLOWABLE MIXTURES AND HAVING MAGNETS AND HOUSING SCRAPERS

[76] Inventor: Howard F. Dyck, G.B. #1301, R.R. #1, Trenton, Ontario, Canada, K8V 5P4

[21] Appl. No.: 409,349

[22] Filed: Mar. 7, 1995

[51] Int. Cl.[6] ..... B04B 11/08; B04B 1/04

[52] U.S. Cl. ..... 494/55; 494/53; 494/79; 210/223

[58] Field of Search ..... 494/31, 33, 44, 494/50, 51, 52, 53, 55, 74, 79, 84, 85; 210/222, 223, 380.1, 380.3, 377

[56] References Cited

U.S. PATENT DOCUMENTS

| | | | |
|---|---|---|---|
| 873,593 | 12/1907 | Phillips | 494/51 |
| 1,062,216 | 5/1913 | Berrigan | 494/51 X |
| 2,522,556 | 9/1950 | Wuensch | 210/223 X |

*Primary Examiner*—Charles E. Cooley
*Attorney, Agent, or Firm*—R. J. Austin

[57] ABSTRACT

A centrifugal separator for a flowable mixture having a housing rotatable defining a separation chamber. At least one magnet is carried by the housing and is rotatable therewith to create a magnetic field within the housing with the magnetic lines of force carried around the axis of rotation during rotation of the housing. The chamber is divided into sub-chambers by radially extending baffles. The mixture is retained in each sub-chamber during housing rotation so as to stabilize the mixture and rotate it together with the housing. Housing scrapers face the inside surface of the housing to remove from that surface material which is attracted to the magnet. This action tends to draw the molecules of the mixture into alignment with the rotating lines of force thereby polarizing the molecules and decreasing molecular bonding. The centrifugal action causes the polarized molecules with decreased bonding, to move apart with the heavier molecules moving radially outwards further from the lighter molecules. Preferably, the housing is mounted on a central hollow shaft along which the mixture flows towards the chamber. In the shaft, the mixture is rotated towards or at the rotational speed of the housing and with the magnetic lines of force extending into the shaft and also rotating, some polarization and resultant weakening of molecular bond results followed by molecular separation in the shaft before the mixture reaches the chamber.

13 Claims, 4 Drawing Sheets

CENTRIFUGAL SEPARATOR FOR FLOWABLE MIXTURES AND HAVING MAGNETS AND HOUSING SCRAPERS

This invention relates to centrifugal separators for flowable mixtures and is particularly concerned with centrifugal separators for water desalinization. This invention is not limited to water desalination, and may be adapted to many other uses.

DESCRIPTION OF THE PRIOR ART

The present systems using distillation, evaporation or reverse osmosis, are expensive, slow, power hungry and require a considerable amount of maintenance. This technology is well documented and familiar to those working in this field.

SUMMARY OF THE INVENTION

The general object of this invention is to provide a centrifugal separator for separating materials from a flowable mixture of materials. In particular, an object is to separate salt and other contaminating material from sea water. This is accomplished by passing the mixture through a strong magnetic field inside the separator. Magnetic lines of force are rotated together with a housing of the separator, the mixture also rotating to align molecules of the mixture with lines of force. Molecular bonding then becomes weaker thereby allowing for ease of molecular separation under centrifugal force.

The main shaft of the separator (referred to herein as "rotor") is hollow, which in the case of sea water allows water to pass through the strong magnetic field before entering into the water separation chamber. Guide vanes, attached to the rotor shaft at the water inlet, rotate with the rotor shaft. These guide vanes accelerate the incoming water in a circular direction, to match that of the rotorshaft and the rotor.

Below the intake guide vanes is a set of flow-stabilizing spiral baffles that extend down to the rotor shaft lower water sealing plate. They rotate inside the main rotor shaft where they also act as cleaning augers, removing any magnetic particles that may have adhered to the inner surface of the rotor shaft.

At the lower end of the main rotor shaft are water ports that allow the incoming water to enter the main water separation chamber of the centrifuge. This main chamber is divided into four separate chambers by vertical baffles that direct and stabilize the water flow inside the main chamber. They are designed and connected so as not to interfere with the rotation of a cleaning auger positioned around the outside of magnets provided to create the magnetic field. Situated between the inner and outer housing of the main chamber is a scavenging auger, which removes the densest water layer and any magnetic particles that may have adhered to the inside of outer electro magnets and the inside of the outer housing.

An auger driven power input shaft is attached through the hollow rotor shaft. Through gear trains mounted on the shaft it drives the three augers at a slightly reduced speed than that of the rotor. This speed differential, in conjunction with blade twist, creates the desired auger action for the separate augers.

The upper end of the main water separation chamber is divided by two conical separation baffles, that form two water exit channels and a slurry check baffle. The water flow from the two exit channels is adjusted by automatically controlled valves, in order to maintain the desired water quality of the cleansed water exiting the centrifuge.

The magnetic field may be provided by permanent or electromagnets. Where electromagnets are employed, conveniently slip ring and brush assemblies are located on the main rotor drive shaft.

BRIEF DESCRIPTION OF THE DRAWINGS

One embodiment of the invention will now be described, by way of example, with reference to the accompanying drawings, in which.

DETAILED DESCRIPTION OF THE INVENTION

Figure 1:
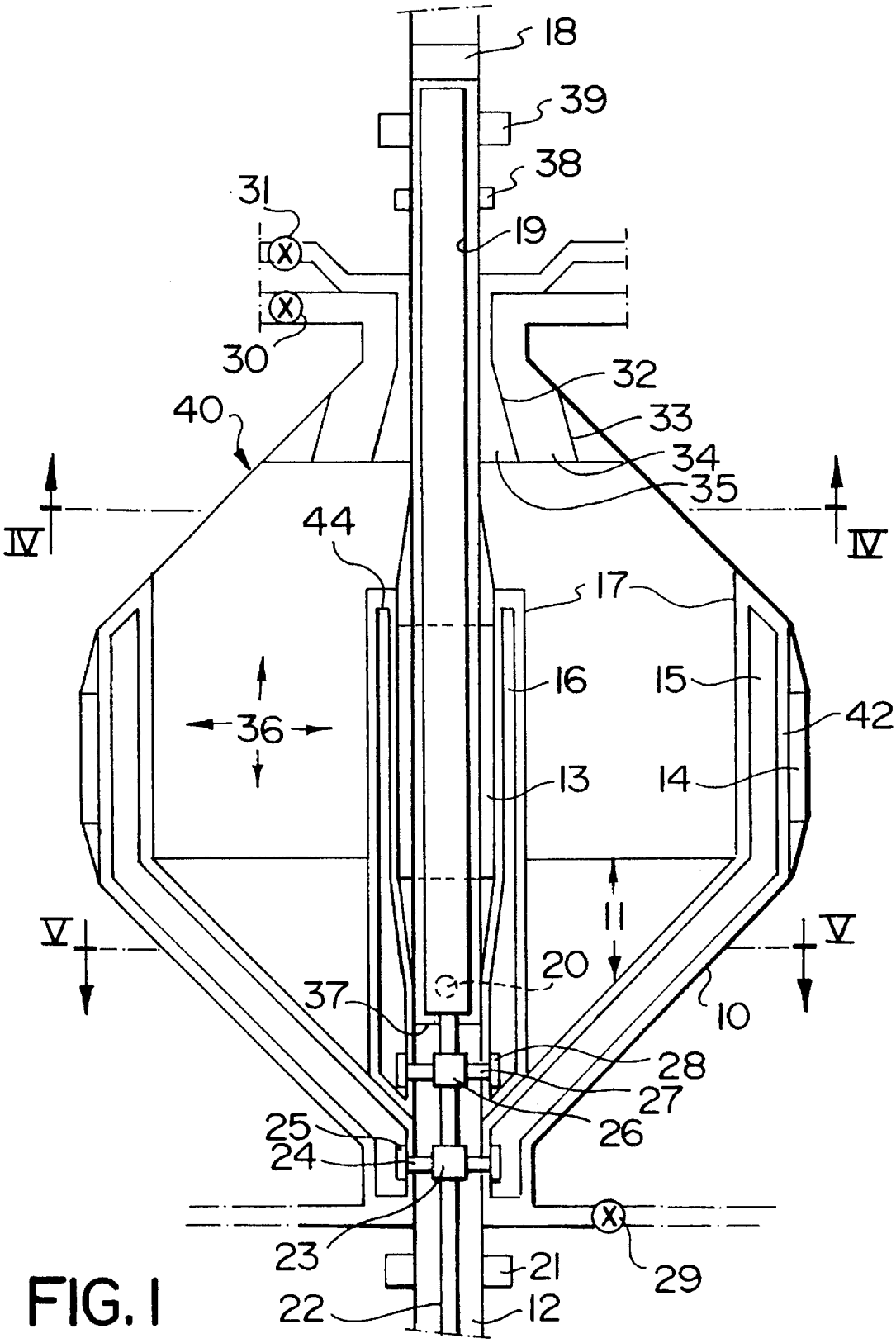
FIG. 1 is a cross-sectional view, taken along the rotational axis of a rotatable housing, of a centrifugal Separator according to the embodiment.
Figure 2:
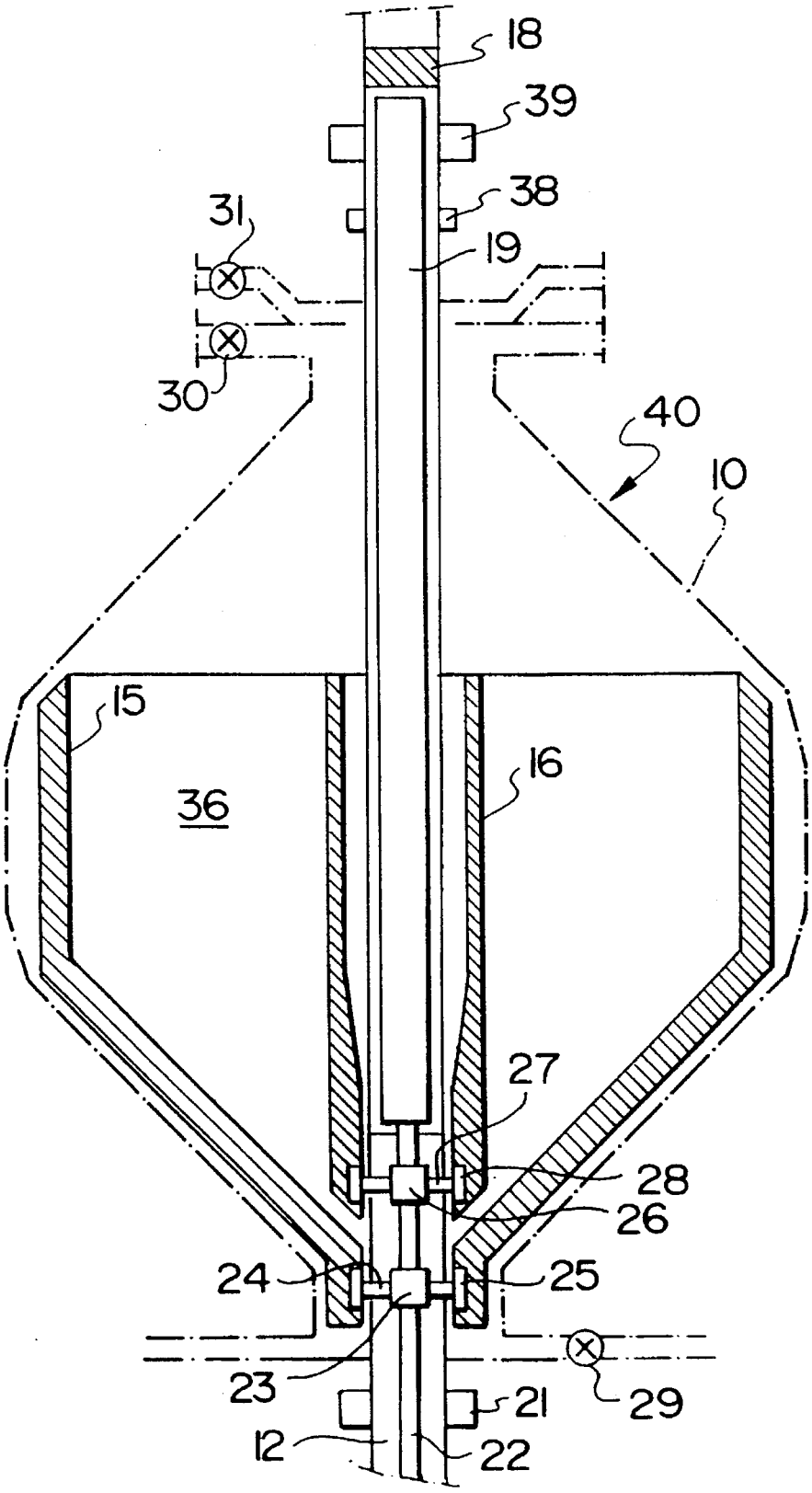
FIG. 2 is a view similar to FIG. 1 and showing a scraper arrangement highlighted and the outline of the remainder of the apparatus shown in chaindotted.

FIG. 1 shows a magnetically stimulated centrifugal separator assembly 40, hereafter referred to as "the rotor", connected to a driven input member that forms a hollow main rotor center shaft 12 which provides a water intake passage, hereafter called the rotor shaft. The rotor shaft 12 is supported at the upper and lower ends by the rotor shaft support bearings 21 and 39 which are supported by the centrifuge support (not shown). The rotor outer housing 10, and the rotor inner housing 11, are connected to the rotor shaft 12 to form the rotor water separation chamber 36. This said chamber 36 is divided by flow stabilizing baffles 17 that are connected to the rotor outer housing 10, the rotor inner housing 11, and the rotor shaft 12. The said baffles 17 are connected parrallel to, and perpendicular with, the rotor shaft 12, and form water separation sub-chambers. The purpose of these sub-chambers is to prevent turbulence in the water separation chamber 36.

At the upper end of the rotor water separation chamber 36, two conical baffles 32 and 33 are connected to the rotor outer housing 10 and supported by the flow stabilizing baffles 17. The conical baffle 32 form two water exit channels, the cleansed-water outflow channel 34, and the light fluid outflow channel 35; the flow through these channels being controlled by control valves 30 and 31. The conical baffle 33 prevents slurry flowing into the cleansed water outflow channel 34.

A slurry removal channel 42 is formed between the inner and outer rotor housing 10 and 11. A slurry removal auger 15 rotates in this channel at a slightly slower speed than the rotor 40. This speed differential allows the slurry auger 15 to remove the slurry from the outer housing 10, down to the slurry flow control valve 29. The inner magnet cleaning auger 16, rotates in a channel 44 between the outside of the inner magnets 13 and the flow stabilizing baffles 17, and rotates at a slightly slower speed than the rotor 40.

The rotor shaft inner cleaning auger 19 rotates inside the passage of the rotor shaft 12 at a slightly slower speed than said rotor shaft. The rotor shaft inner cleaning auger 19 extends from the water inlet guide vanes 18, at the upper end of the rotor shaft 12, down to a water sealing plate 37 that forms the base of the water intake channel just below the water intake outlet—ports 20.

The water acceleration inlet guide vanes 18 are connected to the inner surface of the rotor shaft 12. The purpose of the guide vanes 18 is to accelerate the incoming water to the same rotational speed as that of the rotor shaft 12.

The auger drive input shaft 12 extends upwards; through the rotor shaft lower main support bearing 21, passes through the inner rotor housing 11, passes through the rotor shaft lower water sealing plate 37, and is then connected to the rotor shaft inner cleaning auger 19.

The inner electromagnet 13 fits around and is connected to the rotor drive shaft 12 at or near the centre of the rotor water chamber 36. The electric current-carrying conductors are run through conduits and connected to the slip ring and brush assembly 38, the brush assembly being attached to an outside electrical power and control source (not shown). The outer electromagnet 14 is connected to the inner surface of the rotor outer housing 10, at or near the centre of the rotor water chamber 36 and is connected to the slip ring and brush assembly 38 by current-carrying conductors.

Figure 3:
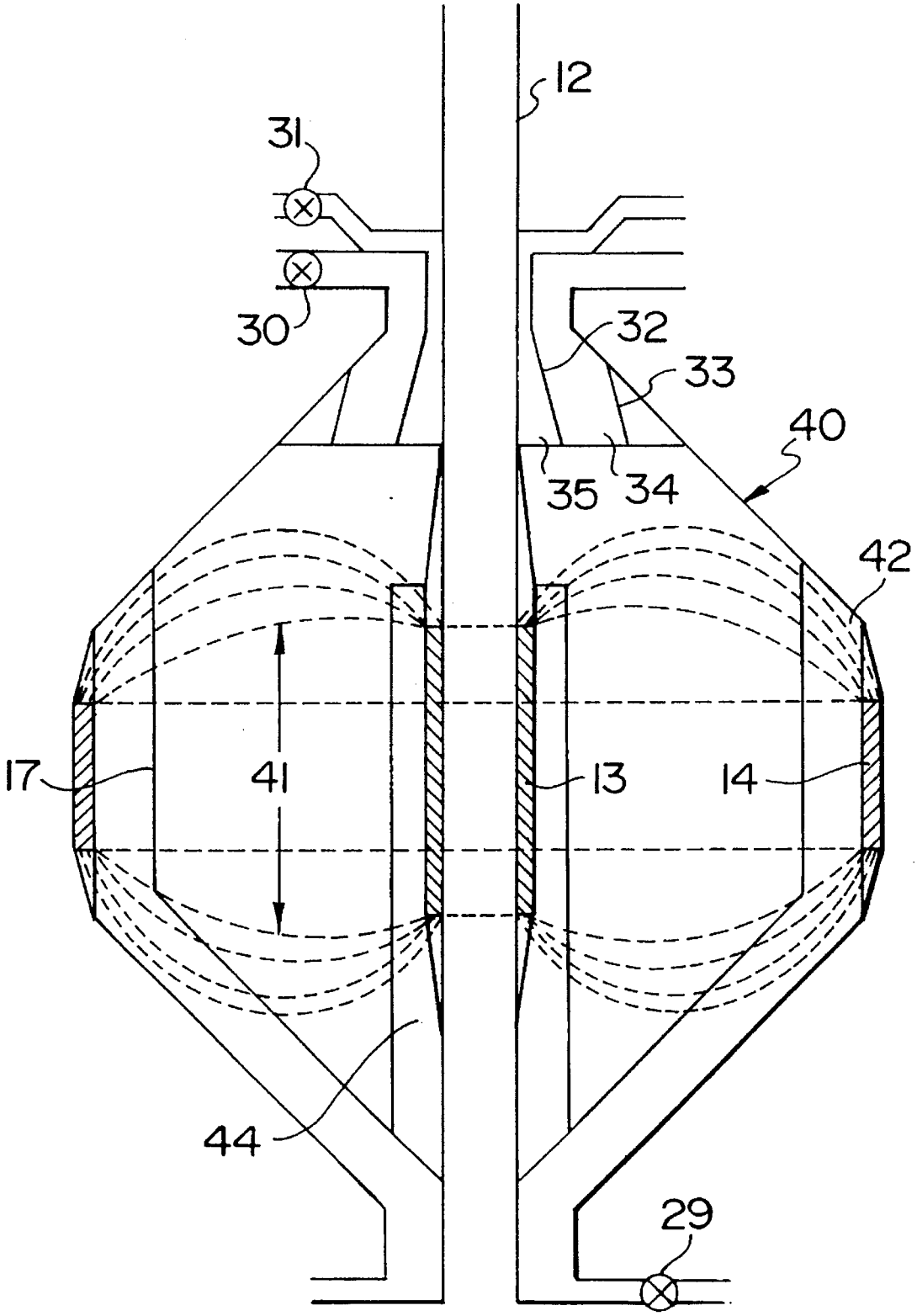
FIG. 3 is a view similar to FIG. 1 showing diagrammatically, magnetic lines of force.
Figure 4:
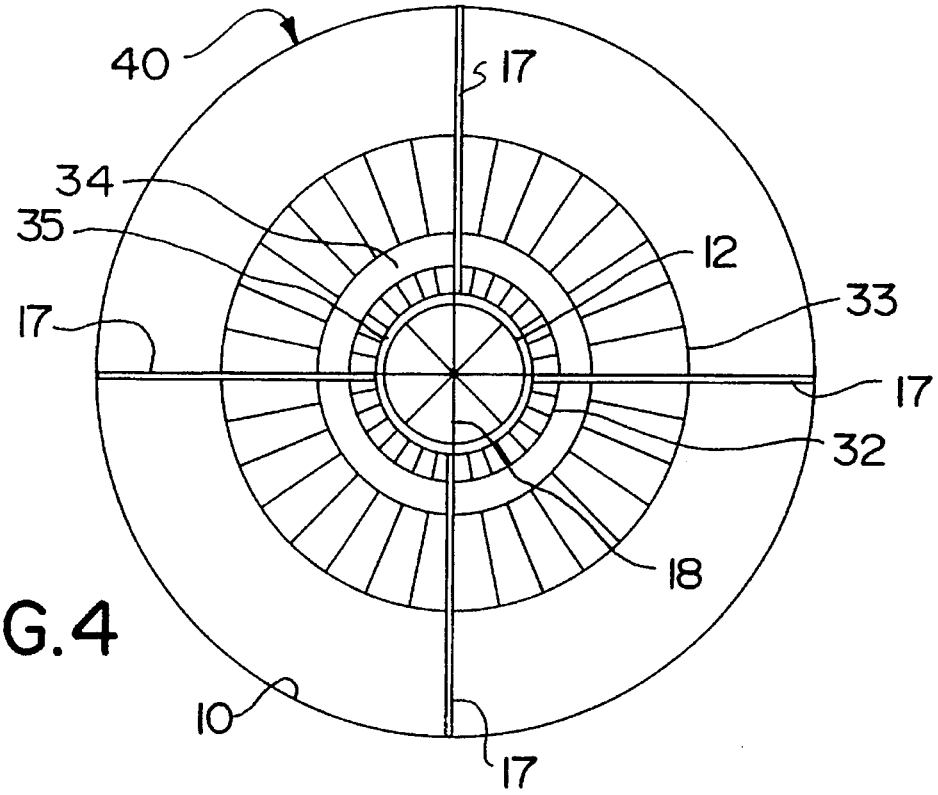
FIG. 4 is a cross-sectional view of the separator taken along line 1V—1V in FIG. 1 with an inner cleaning auger removed.
Figure 5:
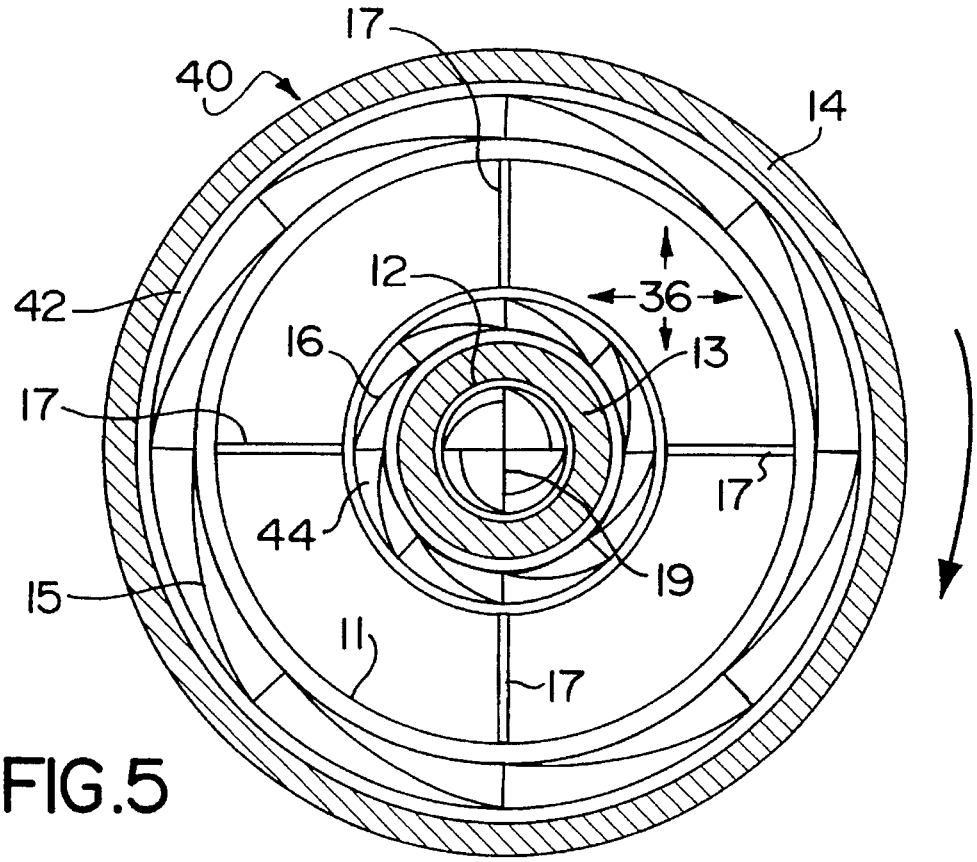
FIG. 5 is a cross-sectional view of the separator taken along line V—V in FIG. 1.

The inner electromagnet 13 is energised to produce a north seeking pole at the upper end, and the outer electromagnet 14 is energized to produce a south seeking pole at the upper end. This arrangement produces a magnetic flux field 41 (FIG. 3) across the horizontal plane of the water separation chamber 36 at the upper and lower ends of the electromagnets 13 and 14.

The slurry auger 15 is rotated within the channel 42 by a planetary gear set 23, 24 and 25, the ring gear 25 of which is secured to the slurry auger 15, and meshes with the planet gears 24 through ports in the rotor shaft 12. The planet gears 24 are rotatably carried by the rotor shaft 12 and are suitably sealed against slurry ingress. The planet gears 24 mesh with the sun gear 23 of the gear set, the sun gear being secured around the auger drive input shaft 22.

The inner magnet cleaning auger 16 is rotated around the outside of the inner magnet 13 by a planetary gear set 26, 27 and 28. The ring gear 28 of this set is secured to the inner magnet cleaning auger 26 and meshes with the planet gears 27 through ports in the rotor shaft 12. The planet gears 27 are rotatably carried by the rotor shaft 12, and are suitably sealed against fluid ingress. The sun gear 26 is secured around the auger drive input shaft 22, and meshes with the planet gears 27.

The auger drive input shaft 22 extends upward through the rotor shaft lower water sealing plate 37, and is connected to the rotor shaft inner cleaning auger 19. A discussion of the principle of operation and the operation of the various components will be explained under the sub-heading "operation".

All of the above-mentioned components, such as seals, valves, and control systems, are well known to those individuals skilled in industrial, mechanical, and electrical systems, and will not be described in detail here.

OPERATION

Referring to FIG. 1. The centrifuge rotor 40 is first brought up to a pre-determined speed for the particular unit being operated and the composition of the water being processed. When on-speed, direct electric current is turned onto the electromagnets 13, and 14, and adjusted to the predetermined value.

The input water valve (not shown) is opened and the rotor assembly 40 is allowed to fill and pressurize. When the pressure has stabilized in the rotor water separation chamber 36, the outflow valves 30 and 31 are opened by the valve control system, and regulated to achieve the desired water quality from the cleansed—water outflow valve 31. The slurry valve 29 is automatically controlled to maintain the removal of the slurry at the rate that would keep the water in the slurry outflow channel at the desired consistency.

The water flowing from the intake manifold (not shown) is in a linear flow state and must change to the circular state and rotational speed of the rotor shaft 12. This is accomplished by the water inlet guide vanes 18 with the assistance of the rotor shaft inner cleaning auger 19 which rotates slightly slower than the shaft 12. The said auger 19 acts to clean the surface of the inner rotor shaft 12 and as a water flow stabilizer. A slight speed differential between the said auger 19 and the rotor shaft 12, combined with the pitch of said auger 19, causes a downward movement of any material removed from the inner surface of the rotor shaft 12. As the water moves down the inside of the rotor shaft 12 it flows through the magnetic field created by the inner magnets 13. Since the water and the magnetic field are rotating at nearly the same speed, the water molecules are polarized along the vertical axis of the rotor 40. This polarization decreases the molecular bonding between the different size and type of molecules. When the water reaches the lower end of the rotor shaft 12, it flows through exit ports 20 into the main water separation chamber 36, where it is directed upwards into the main water separation chamber by the angle of the inner rotor housing 11. The water flow is stabilized inside the rotating chamber by the flow stabilizing baffles 17. Pressure exerted on the water from the inlet manifold, the angle of the inner rotor housing 11 and the centrifugal force exerted by the centrifuge rotor, forces the water upward and outward. As the water passes up through the magnetic field created by the inner magnet 13 and outer magnet 14, the polarization of the molecules is strengthened, thereby further decreasing the molecular bonding of the water. This allows the molecules to drift apart due to centrifugal force, and into circumlinear flow patterns of stratified layers along the vertical axis of the rotor 40. The heavier material, such as salt, drifts to the outside of the rotor 40 where the scavenging auger 15 moves it down to the slurry flow control valve 29, where it exits into a collector manifold (not shown).

When the water approaches the top of the rotor 40, the circularly stratified layers are separated by the conical baffle 32 into two separated flow channels 34 and 35; channel 34 being the cleansed-water outflow, and channel 35 the lighter fluid outflow. The slurry stop baffle 33 prevents any slurry material being carried into the cleansed-water outflow channel 34. The water outflow is controlled by control valves 30 and 31 to maintain the desired water quality of the cleansed-water outflow.

The inner magnet cleaning auger 16 rotates around the outside of the inner magnet 13, and removes any ferrous metal and/or other magnetic material from adhering to said magnet and disrupting the magnetic field 41. This said auger 16, rotates slightly slower than the rotor 40, and moves the material down and away from the magnet. Centrifugal action and water flow allows the material to drift to the outer rotor housing 10, where it is removed by the slurry auger 15.

The auger-drive input shaft 22 controls the speed differential between all three cleaning augers 15, 16 and 19, and the shaft 12 and housings 10 and 11. This speed differential can be varied by adjusting the speed of the said input shaft so as to suit varying water input composition.

The rotational speed of the shaft 12 and housings 10 and 11 is controlled by an automatic control system to adjust for different input-water conditions, but must be sufficient to produce a centrifugal force of at least 10 "G"s (or ten times the standard force of gravity). The strength of the magnetic field is also varied depending on the composition of the water being processed. In small centrifuge units such as for domestic purposes—permanent magnets may be substituted for the electro-magnets, which would reduce the production costs.

While the invention has been described with the centrifugal separator assembly 40 in the vertical position, it can readily be adapted to operate with the assembly in the horizontal position. It is to be understood that many alternatives, modifications and variations will be apparent to those skilled in the art in light of the foregoing description. Accordingly, this invention is intended to embrace all such alternatives, modifications and variations which fall within the spirit of the appended claims.

The embodiment of the invention in which an exclusive property or privilege is claimed are defined as follows:

1. A centrifugal separator comprising a centrifuge housing defining a separation chamber, the housing rotatable around an axis of rotation, the housing having an inlet for a flowable mixture of materials to be separated within the separator with the inlet at a radially inward location relative to the separation chamber, a magnet arrangement rotatable with the housing, the magnet arrangement extending around the rotational axis to create a magnetic field within the housing with magnetic lines of force carried around the axis of rotation during rotation of the housing for polarizing molecules of the mixture which are aligned with the lines of force to decrease molecular bonding, a plurality of baffle plates extending radially within and rotatable with the housing, the baffle plates separated angularly around the rotational axis to divide the separation chamber into sub-chambers between the baffle plates for stabilization of the flowable mixture within each sub-chamber during rotation of the housing to draw molecules of the mixture towards alignment with the rotating lines of force, and a housing scraper facing an inside surface of the housing to remove from the housing surface material attracted to the magnet arrangement during centrifugal separation, the housing having at least two outlets spaced apart in the direction of the rotational axis, each outlet for removal of at least one separated material from the mixture.

2. A separator according to claim 1 wherein the housing is rotatably carried upon a hollow shaft extending concentrically within the housing, the shaft providing a passage for the flow of the flowable mixture to direct the mixture to the inlet to the chamber, the inlet being defined by the hollow shaft, and wherein the magnet arrangement comprises a magnet positioned around the hollow shaft to produce magnetic lines of force within the passage to polarize molecules of the mixture in the passage which are aligned with the lines of force to decrease molecular bonding, the separator further comprising means within the passage to provide rotation of the mixture flowing along the passage in the same rotational direction as the housing and towards the rotational speed of the housing to draw molecules of the mixture in the passage towards alignment with the rotating lines of force to allow for separation of the molecules within the passage, and a passage scraper for removing from the passage surface material attracted by the magnet arrangement.

3. A separator according to claim 2 wherein the means within the passage to provide rotation comprises a plurality of vanes mounted within the hollow shaft, each vane extending longitudinally of the shaft and around the rotational axis.

4. A separator according to claim 3 wherein the housing is secured to the hollow shaft and the shaft rotates with the housing.

5. A separator according to claim 4 wherein the passage scraper extends around the rotational axis in a direction to assist rotation of the mixture within the passage in the same rotational direction as the housing.

6. A separator according to claim 4 wherein the magnet arrangement comprises a radially outer magnet and a radially inner magnet, each magnet extending around the rotational axis, and an individual housing scraper is disposed adjacent each magnet, each individual housing scraper facing an inside surface of the housing to remove from the housing surface material attracted to the magnet arrangement during centrifugal separation, and a rotatable driving shaft extends axially within the hollow shaft, the driving shaft driveably connected to each housing scraper and the passage scraper extends axially from and is rotatable together with the rotatable shaft.

7. A separator according to claim 2 wherein the passage scraper is rotatably driveable at a different rotational speed from the housing and the magnet.

8. A separator according to claim 2 wherein the magnet positioned around the hollow shaft is a radially inner magnet and the magnet arrangement further comprises a radially outer magnet spaced radially outwardly from the radially inner magnet and extending around the rotational axis, and an individual housing scraper is provided adjacent to each magnet, each housing scraper facing an inside surface of the housing to remove from the housing surface material attracted to the magnet arrangement during centrifugal separation, and each housing scraper is rotatably driveable at a rotational speed different from that of the housing and of the magnets.

9. A separator according to claim 8 wherein a rotatable driving shaft extends axially within the hollow shaft, the driving shaft driveably connected to each of the housing scrapers by a gear train comprising a driven gear carried by the housing scraper, a driving gear carried by the driving shaft, and at least one intermediate gear driveably connecting the driving and driven gears and rotatably carried by and extending through the hollow shaft.

10. A separator according to claim 9 wherein the passage scraper extends axially from and is rotatable together with the rotatable driving shaft.

11. A separator according to claim 8 wherein the housing comprises an annular radially outer housing element and an annular radially inner housing element spaced from the outer housing element to provide an annular chamber for collection of slurry with the separation chamber disposed radially inwards of and in communication with the annular chamber, and the outer magnet is carried by the outer housing element with the housing scraper adjacent to the outer magnet being disposed within the annular chamber.

12. A separator according to claim 1 wherein the magnet arrangement comprises at least one electromagnet rotatable with the housing and the electromagent is provided with slip ring and brush means to connect the electromagnet to a source of electric power.

13. A separator according to claim 1 wherein the magnet arrangement comprises at least one permanent magnet rotatable with the housing.

* * * * *